US006942735B2

(12) United States Patent
Rich

(10) Patent No.: US 6,942,735 B2
(45) Date of Patent: Sep. 13, 2005

(54) ADJUSTABLE SPRAY APPARATUS WITH MULTIPLE OUTLETS

(75) Inventor: David D. Rich, Zionsville, IN (US)

(73) Assignee: Rich Roofing Systems, Inc., Zionsville, IN (US)

( * ) Notice: Subject to any disclaimer, the term of this patent is extended or adjusted under 35 U.S.C. 154(b) by 118 days.

(21) Appl. No.: 10/622,531

(22) Filed: Jul. 18, 2003

(65) Prior Publication Data

US 2005/0013942 A1 Jan. 20, 2005

(51) Int. Cl.[7] ..... B05B 1/00

(52) U.S. Cl. ..... 118/313; 118/323; 239/147; 239/159; 239/164; 239/170; 239/176; 239/550

(58) Field of Search ..... 239/147, 159, 239/164, 170, 176, 337, 550, 566; 118/313, 323

(56) References Cited

U.S. PATENT DOCUMENTS 3,106,344 A * 10/1963 Baird, Jr. et al. ..... 239/130
3,500,620 A * 3/1970 Duran et al. ..... 56/12.8
4,252,274 A * 2/1981 Kubacak ..... 239/163
4,491,608 A 1/1985 Thygesen
4,553,702 A * 11/1985 Coffee et al. ..... 239/690
4,638,948 A * 1/1987 Marlek ..... 239/722
4,828,177 A * 5/1989 Schuitemaker ..... 239/165
4,893,751 A * 1/1990 Armstrong ..... 239/150
4,962,892 A * 10/1990 Sauer ..... 239/722
6,060,555 A 5/2000 Wright
6,230,091 B1 * 5/2001 McQuinn ..... 701/50

* cited by examiner

*Primary Examiner*—Chris Fiorilla
*Assistant Examiner*—Michelle Acevedo Lazor
(74) *Attorney, Agent, or Firm*—Woodard, Emhardt, Moriarty, McNett & Henry LLP

(57) ABSTRACT

An adjustable spray apparatus with multiple outlet for applying a flowable coating onto a non-vertical surface. A carriage includes an outwardly extending arm with a plurality of downwardly facing spray tips connected to a manifold mounted on the carriage. The manifold, in turn, is connected to a remotely located reservoir of flowable material. An auxiliary spray gun in connected to the manifold.

2 Claims, 3 Drawing Sheets

ADJUSTABLE SPRAY APPARATUS WITH MULTIPLE OUTLETS

BACKGROUND OF THE INVENTION

The present invention relates generally to the field of devices for spraying coatings on various objects and in particularly onto roofing structures.

DESCRIPTION OF THE PRIOR ART

A variety of materials are used to coat the upwardly facing surface of a roof. Elastomeric flowable materials are typically applied to flat roofs whether the roofs extend horizontally or are inclined. The elastic coating resembling rubber provides a water tight seal and covers over defects in the roof originating at construction or during the life of the roof as the roof is exposed to the weather.

It is the custom to spray elastomeric coating onto a roof by means of a hand held spray gun that is manually moved across the width and length of the roof. In many cases, scaffolding must be constructed to allow the worker to stand adjacent the roof as the spray gun is moved in a back and forth motion such as disclosed in the U.S. Pat. No. 6,060,555.

In lieu of the scaffold approach, the worker may stand on the roof and apply the particular material onto the roof such as disclosed in the U.S. Pat. No. 4,491,608. In either case, a reservoir or supply of material or coating to be applied is located at ground level and then forced upwardly by means of a pump to the dispenser either adjacent or atop the roof.

The prior methods and devices for applying the coating have many disadvantages. By utilizing a single outlet, such as shown in the aforementioned patents, the coating is applied in a relatively narrow path across the roof with the outlet then being moved adjacent the path and moved again across the roof. The result is that the coatings from adjacent paths either overlap causing excess material to be applied to the roof or gaps are left between the paths where no coating is applied. The process is long and tedious in that the spray gun must be moved repeatedly across the roof in adjacent paths. When coating a large roof, the worker must stand atop the roof instead of a scaffold since the spray gun is not sufficiently long to reach the entire roof. Thus, the coating material will cake on the workers shoes and clothing as the worker walks back and forth across the roof. Further, if a large dispenser is carried by the worker such as shown in the U.S. Pat. No. 4,491,608, then the worker is constantly exposed to the material as the material falls onto the roof.

Disclosed herein is a device having a plurality of outlets applying the coating simultaneously in multiple paths as the device is moved across the roof thereby reducing the time and effort to coat the roof. Further, the outlets are positioned to the side of a wheeled carriage ensuring that the worker does not have to walk atop the coating. Likewise, the coating does not fall on the workers shoes or clothing. Most importantly, the device is adjustable to vary the spacing between the coating outlets and the roof as well as the spacing between adjacent outlets thereby accurately controlling the coating pattern in a consistent manner across the width and length of the roof. The coating outlets are positioned to the side of the wheeled device or carriage thereby ensuring that the coating is not sprayed onto the carriage, wheels or operator pushing the carriage. A handle is pivotally mounted to the carriage and may be swung between the opposite ends of the carriage allowing the operator to push the carriage to the end of the roof and then simply pivot the handle over the opposite carriage end to reverse travel of the carriage as the handle is pushed in the opposite direction. In this manner, the coating outlets may be moved to the ends of the roof without requiring the carriage to be turned around conceivably forcing the wheels onto the roof coating.

The carriage disclosed herein includes a plurality of wheels adjustably mounted so that the widthwise spacing of the wheels on the carriage may be conveniently adjusted controlling the carriage footprint depending upon the roof inclination and the contour of the surface being coated.

SUMMARY OF THE INVENTION

One embodiment of the present invention is an apparatus for spraying material on a non-vertical surface comprising a main frame having a longitudinal axis. Front and back wheels are rotatably mounted to the frame to allow movement of the frame across the non-vertical surface in a direction along the longitudinal axis. An arm is mounted to the frame and extends outwardly of the frame and the wheels in a direction away from the longitudinal axis. Outlets are connected to a reservoir of the material to be sprayed. The outlets are mounted to the arm and opened downwardly toward the non-vertical surface. A control means is connected to the reservoir to controllably force material within the reservoir and out the outlets onto the non-vertical surface.

Another embodiment of the present invention is a method of spraying a coating onto a roof comprising the steps of providing a reservoir of flowable roof coating and a carriage having wheels and a plurality of nozzles positioned aside the carriage; positioning the carriage atop a roof; positioning the reservoir atop ground apart from the roof; connecting the nozzles on the carriage to the reservoir; moving the carriage across the roof; forcing the flowable roof coating from the reservoir to the nozzles and then simultaneously from the plurality of nozzles onto the roof.

It is an object of the present invention to provide a new and improved device and method for applying coatings to roof structures.

A further object of the present invention is to provide a coating dispenser including adjustment means to control the coating pattern.

A further object of the present invention is to provide a roof-coating dispenser for applying multiple paths of coating to a roof.

Yet a further object of the present invention is to provide a roof-coating dispenser minimizing exposure of the coating to the worker.

Related objects and advantages of the present invention will be apparent from the following description.

DESCRIPTION OF THE PREFERRED EMBODIMENT

Figure 1:
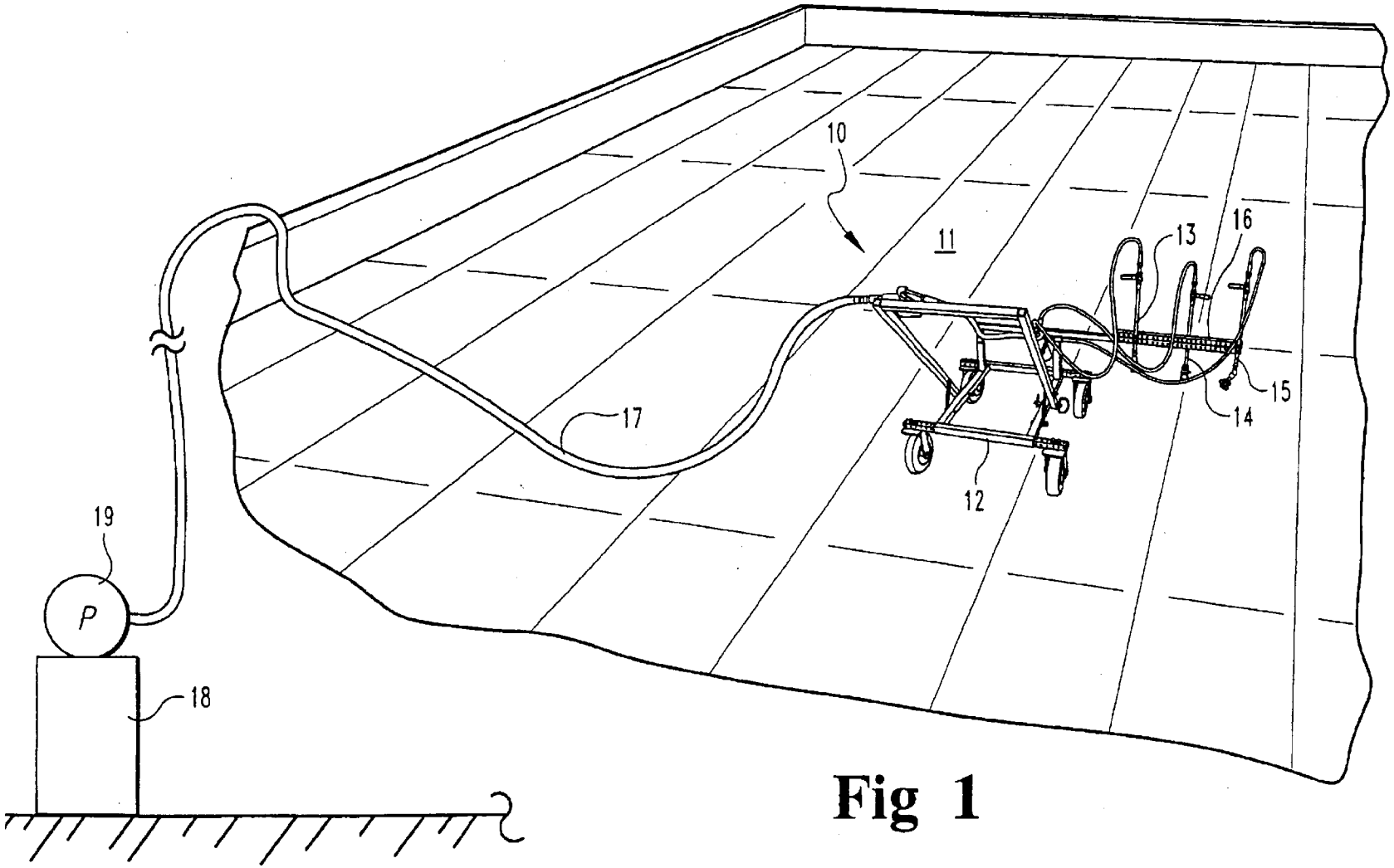
FIG. 1 is a rear view of the sprayer incorporating the present invention illustrated atop a roof and connected to a pressurized reservoir.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown an apparatus for spraying material onto a non-vertical surface, such as a roof. The apparatus includes a sprayer 10 atop a non-vertical surface, such as a roof 11. The sprayer includes a main frame 12 with a plurality of wheels rotatably mounted thereto to allow movement of the frame across the roof. A plurality of nozzles 13, 14 and 15 are mounted to an arm 16, in turn, mounted to and extending outwardly of frame 12. The nozzles are connected via a hose 17 to a reservoir 18 located at ground level. The reservoir includes the material to be sprayed onto the roof with a conventional pump 19 provided to force the material within the reservoir upwardly through hose 17 to the outlet nozzles.

Many variations are contemplated and included regarding the design of the main frame 12. The frame illustrated in FIGS. 2 and 3, includes a plurality of members interconnected together that may be adjusted to control not only the spacing of the wheels but also the nozzles mounted to the arm extending outwardly from the frame.

Frame 12 includes a pair of parallel members 20 and 21 connected to a pair of end tubes 22 and 23. Rear wheels 24 and 25 along with front wheels 26 and 27 are rotatably mounted by conventional means to frame 12. For example, wheel 25 is rotatably mounted by an axle 28, in turn, fixedly mounted to the bottom ends 29 of an inverted u-shaped bracket 30. The top wall of bracket 30 is mounted to the outer end of member 31 slidably mounted within tube 22. Each wheel is rotatably mounted to an inverted u-shaped bracket that is removably mounted to the outer ends of members slidably mounted within tubes 22 and 23. That is, members 33, 37 and 38 have wheels 27, 24 and 26 mounted thereto and are slidably mounted within tubes 22 and 23. Members 31, 33, 37 and 38 have holes extending therethrough that align with holes extending through tubes 22 and 23 to receive pins, for example pins 34 and 35, to releasable hold the members to the tubes. Thus, the wheel spacing may be controlled by moving each wheel to and from axis 32. The u-shaped brackets, namely bracket 30, may be pivotally mounted to the main frame in a conventional castor configuration to allow the wheels to pivot about a vertical axis. The longitudinal axis 32 extends through the length of the main frame and may be positioned centrally with respect to the wheels.

A pair of upright tubes 36 and 57 are mounted to members 20 and 21 and slidably receive members 80 and 81. Members 80 and 81 include a plurality of holes alignable with holes provided in tubes 36 and 57 with removable pins 82 extending therethrough. A crossbeam or arm 16 is perpendicularly mounted to members 36 and 57 and extends outwardly to the side of the main frame. The outlets are then mounted to the outward portion of the arm. Thus, members 80 and 81 may be adjusted upward or downward to control the spacing between the outlets and the sprayed surface.

A handle 40 includes a pair of downwardly extending members 41 and 42 having bottom ends mounted to respectively members 20 and 21. A cross member 43 extends between and is connected to members 41 and 42 to provide rigidity to the handle. Members 44 and 45 have bottom ends connected to members 20 and 21 and top ends connected to members 41 and 42 holding the handle in place.

Figure 2:
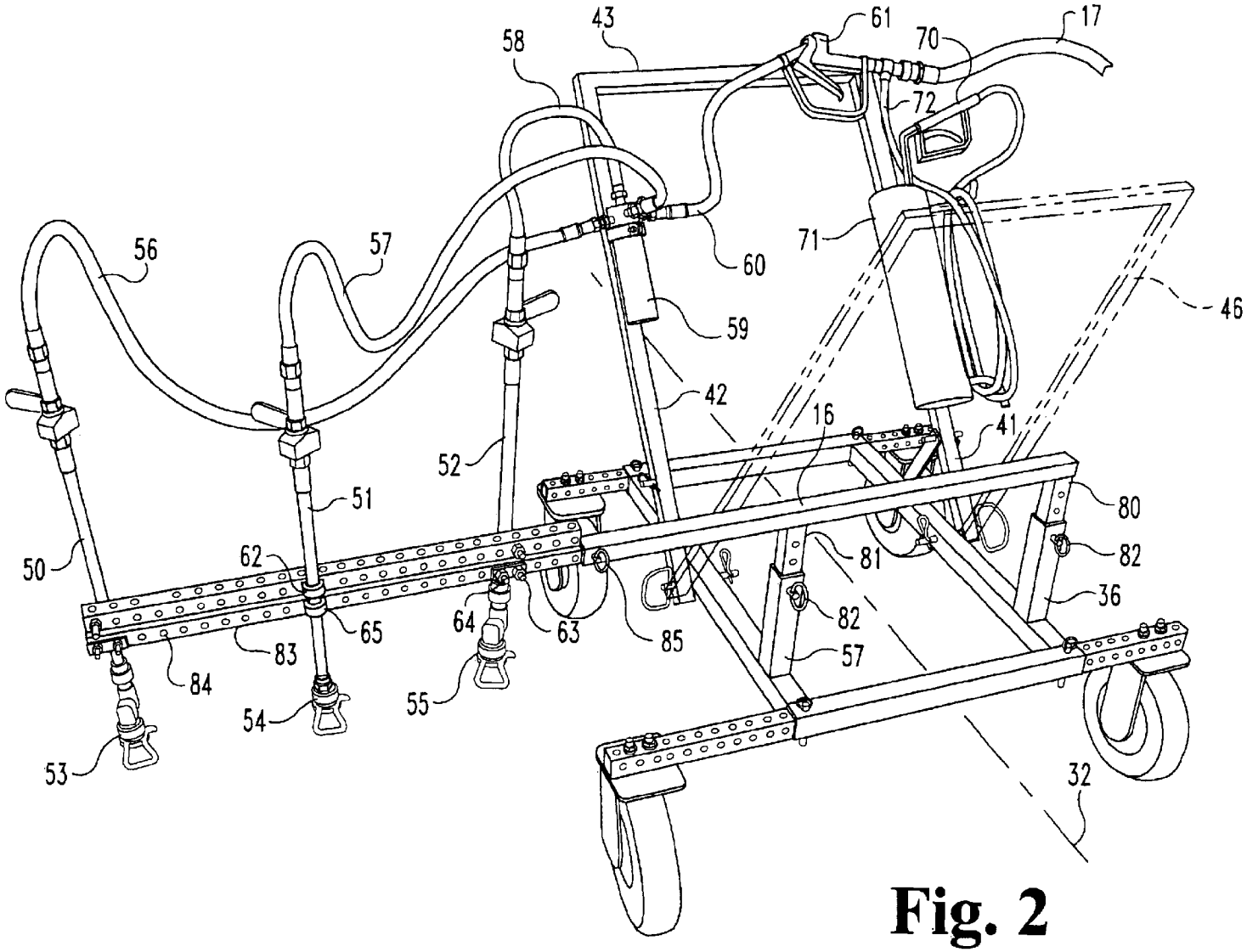
FIG. 2 is a front perspective view of the sprayer.
Figure 3:
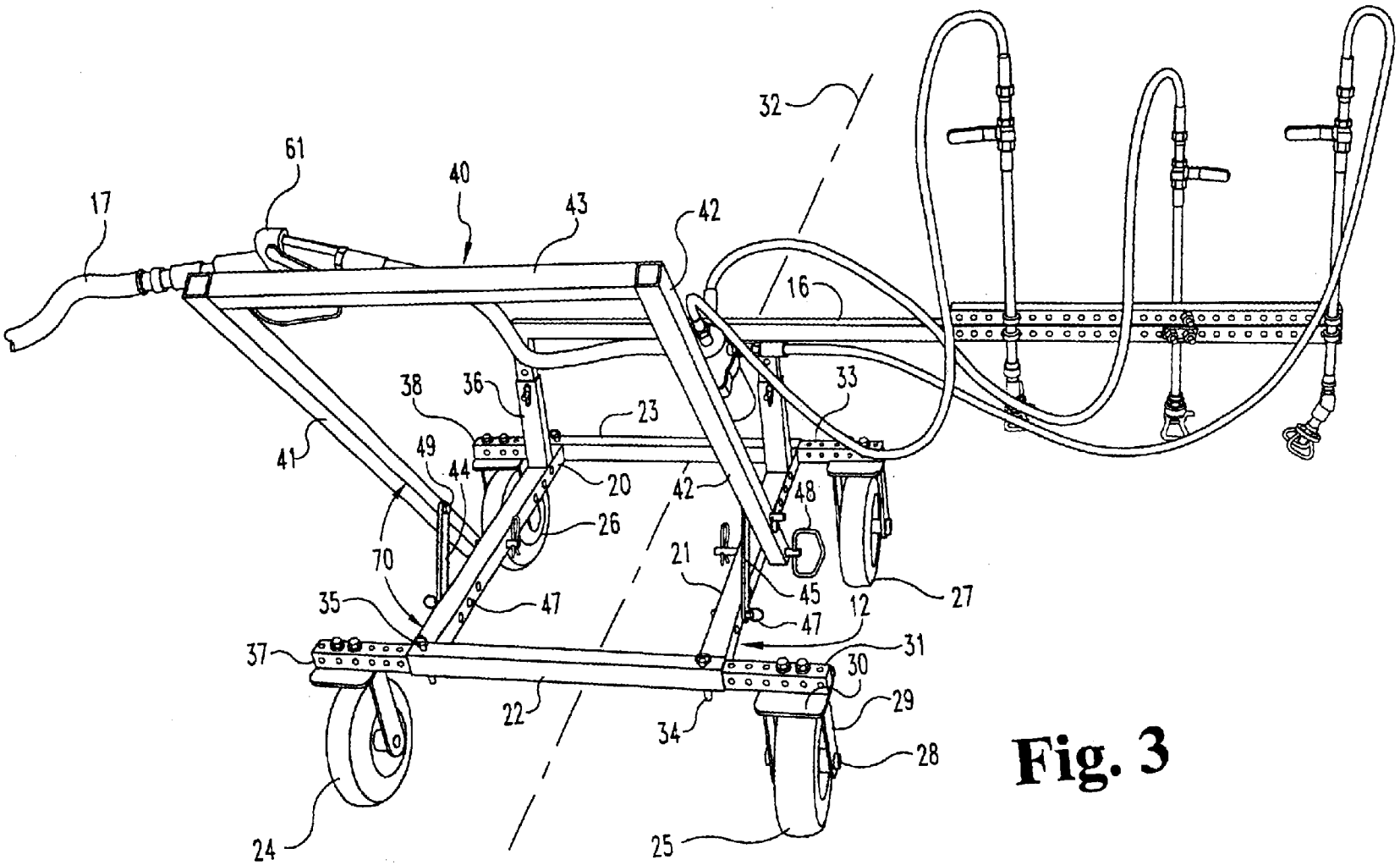
FIG. 3 is a rear perspective view of the sprayer.

The handle is designed to be pivoted from a position extending over the rear of the main frame, that is, rear wheels 24 and 25, to a forward position where the handle overhangs the front wheels 26 and 27 allowing the handle to be pivoted between the two positions depending upon which direction the main frame is to be pushed along longitudinal axis 32. The dashed line representation 46 in FIG. 2 illustrates the handle being in the forward position over the front wheels. In order to move handle 40 from the position over rear wheels 24 and 25 to position 46, where the handle extends over the front wheels 26 and 27, fasteners 47 are removed from the bottom ends of members 44 and 45 and longitudinally extending members 20 and 21 with the handle then pivoting on fasteners 48 securing the bottom ends of members 41 and 42 to longitudinally extending members 20 and 21. Once the handle is in position 46, members 44 and 45 may be pivoted about their top ends connected by fasteners 49 to members 41 and 42 to a forward position whereat fasteners 47 are again inserted through the bottom ends of members 44 and 45 and through members 20 and 21 securing the handle in position 46. Thus, members 44 and 45 along with fasteners 47 and 48 allow the handle to be pivoted to a front position and rear position depending upon the direction of travel of the device along longitudinal axis 32.

A plurality of outlets 53–55 are connected to the bottom ends respectively of tubes 50–52, in turn, removably mounted to member 83 slidably mounted to arm 16. The top ends of tubes 50–52 are connected via respectively hoses 56–58 to a manifold 59 fixedly mounted to one of the upright members of the handle. Manifold 59, in turn, is connected via hose 60 to a hand control 61, in turn, connected to hose 17 extending from the roof downwardly to pump 19 and reservoir 18. Hand control 61 is a conventional on/off valve allowing the pressurized coating within reservoir 18 to control the flow of the coating material through hose 17 and hose 60 to manifold 59.

Manifold 59 includes a chamber receiving the coating material from hose 60 when control 61 is in the open position. Hoses 56–58 are connected to manifold 59 and thereby receive the coating material therefrom. Since the coating material within the manifold is under pressure, the pressurized coating material is applied equally to the outlet hoses 56–58 and eventually to nozzles 53–55.

The hand control and outlets or spray tips are commercially available along with pump 19. For example, spray tips 53–55 may be obtained from Graco, Inc., 88-11$^{th}$ Ave. Northeast, Minneapolis, Minn. 65413.

Spray tubes 50–52 are adjustably held to member 83 by means of conventional brackets 62. Bracket 62 may take any shape. For example, the bracket may include a pair of threaded bolts 63 and 64 extending through member 83 and held in place by standard fastening devices with an offset portion 65 trapping and holding the tubes 50–52 to the member. By loosening the fasteners holding brackets 62 to the member, tubes 50–52 may be moved vertically thereby adjusting the spacing between spray tips 53–55 relative to the roof or other surface to be sprayed. Likewise, bracket 62 may be located at various positions along member 83 to allow for spacing between spray tips. Thus, by adjusting the spacing between tubes 50–52 along with the spacing between the spray tips and roof, the spray pattern of the coating material applied to the roof may be controlled.

Member 83 is provided with a plurality of holes 84 to allow tubes 50–52 to be mounted at various locations along the length thereof. Further, member 83 is slidable relative to arm 16 and is removably held by pin 85 extending through arm 16 into one of the member holes 84 thereby allowing for positioning of the outlet 53–54 to and from axis 32.

An auxiliary spray gun 70 is removably held by a receptacle 71 attached to the handle. Receptacle 71 has a hollow interior to removably hold the spray gun 70 that is commercially available from Graco, Inc. The spray gun includes a hand control as well as a spray tip with the handgun attached via hose 72 to hose 17.

Many variations are contemplated and included in the present invention. For example, the device disclosed has three spray tips mounted to the arm; however, it is to be understood the present invention includes a number of spray tips less than or greater than three.

While the device has been described as applying elastomeric coating materials to a roof, it is to be understood that a variety of materials may be applied by the device. For example, paint may be provided within reservoir 18 to allow application of paint to a structure, such as a metal roof.

In certain instances, it is desired to filter the material being applied and thus, a conventional filter may be mounted within manifold 59, at the outlet of reservoir 18 or at a suitable location between the reservoir and manifold.

In the embodiment depicted in the drawings, arm 16 positions the spray tips along a line extending perpendicular from axis 32 between the front wheels and rear wheels.

The method of spraying a coating onto a non-vertical surface such as a roof includes the steps of positioning a carriage atop a roof with the carriage including a plurality of nozzles or spray tips. A reservoir of flowable roof coating is then positioned atop ground apart from the roof and the reservoir is connected to the nozzles or spray tips by means of a plurality of conduits or hoses. The carriage is then moved across the roof. The roof coating is then forced by means of a pump from the reservoir to the spray tips and then simultaneously from each spray tip onto the roof. The method further includes the step of holding the hose connecting the reservoir to the carriage on the side of the carriage opposite of the spray tips in order to keep the hose apart from the coating sprayed onto the surface by the spray tips. Likewise, the spray tips are kept to the side of the carriage to keep the coating sprayed onto the roof from contacting the wheels of the carriage. The spacing of the wheels on the carriage may be adjusted to provide a desired carriage footprint. Likewise, the spacing of the spray tips from the surface to be coated may be adjusted to provide a desired spray pattern. For example, by positioning the spray tips closer together the sprayed material from one nozzle may overlap the sprayed material from an adjacent nozzle. Further, positioning the spray tips a greater distance from the roof will widen the coating pattern from each spray tip.

The method further includes pushing the handle in a first direction across the surface to be coated along axis 32 and then reversing the direction of carriage travel by adjusting the handle. Handle 40 forms an acute angle 70 (FIG. 3) between members 41 and 42 and the longitudinally extending members 20 and 21. By unfastening members 47, the handle may be pivoted to position 46 where the handle extends over the front wheels thereby changing the angle between the handle and members 20 and 21 to allow grasping and pushing on the handle in a direction opposite along axis 32. Acute angle 70 may be adjusted to position the cross bar 40 at the appropriate elevation for grasping by the operator by locating pins at different locations along the length of members 20 and 21.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for spraying material on a non-vertical surface comprising:

a main frame having a longitudinal axis, said frame further having a first end and an opposite second end;

a plurality of front and back wheels rotatably mounted to said frame to allow movement of said frame across a non-vertical surface in a direction alone said longitudinal axis;

an arm mounted to said frame and extending outwardly of said frame and said wheels in a direction away from said longitudinal axis;

a reservoir to hold material to be sprayed onto the non-vertical surface;

a plurality of outlets connected to said reservoir, said outlets mounted to said arm and opening downwardly toward said non-vertical surface, said outlets being positioned outwardly of said frame and said wheels dispensing said material outwardly of said wheels limiting contact between said material and said front and back wheels;

control means connected to said reservoir to controllably force material within said reservoir and out said outlets onto said non-vertical surface;

a chamber connected to said reservoir to receive material therefrom;

a plurality of conduits connecting separately each of said outlets to said chamber applying equal material pressure within said chamber to each of said outlets;

said arm includes a plurality of outlet mounts releasably receiving said outlets allowing said outlets to be adjusted to and from said non-vertical surface and positioned at various locations along said arm for pattern adjustment of material dispensed onto said non-vertical surface;

a spray gun receptacle mounted to said main frame;

a hand-holdable spray gun connected to said chamber and normally positioned in said receptacle but removable therefrom to manually spray material on said non-vertical surface;

a handle connected to said main frame to grasp and push said main frame in a first direction of travel alone said longitudinal axis across said non-vertical surface while material is dispensed from said outlets;

handle-mounting means on said main frame and connected to said handle operable to allow adjustment of said handle in a first position relative to said main frame at a desired acute angle;

said main frame includes wheel mounting means connected to said plurality of wheels operable to allow adjustment of spacing between said wheels in a direction perpendicular to said longitudinal axis;

said main frame includes mounting means connected to said arm operable to allow adjustment of said outlets relative to said non-vertical surface; and a hose connecting said reservoir to said chamber to locate said reservoir remotely relative to said main frame, said hose extending away from said main frame on a side opposite of said arm allowing positioning said hose apart from material sprayed on said non-vertical surface by said outlets;

said wheels include two front wheels and two back wheels, said arm positions said outlets along a line extending perpendicular from said longitudinal axis between said front wheels and said back wheels; and wherein;

said handle means operable to allow said handle to pivot away from said first position over said first end of said frame to a second position over said opposite second end of said frame to allow said handle to be pushed and said main frame to be moved in a direction reverse from said first direction of travel.

2. A sprayer for dispensing flowable roof coating onto a roof comprising:

a reservoir of flowable roof coating locatable at ground level apart from a roof to be coated;

a wheeled platform with a longitudinal axis locatable atop the roof to be coated, said platform having a front portion and a rear portion and wheels rotatably mounted respectively at said front portion and said rear portion platform;

a handle connected to said platform to grasp and move said platform across the roof, said handle is movably mounted to said platform and movable from a forward position overhanging said front portion of said platform to a second position overhanging said rear portion of said platform;

a boom mounted to said platform and extending to the side thereof;

a plurality of nozzles mounted to said boom outwardly of said platform;

conduits connecting said nozzles to said reservoir; and, a pump connected to said reservoir operable to force flowable roof coating therein through said conduits and out said nozzles to the side of said platform as said platform is moved across said roof; and wherein:

said platform is movable in a first direction when said handle is pushed when located over said front portion and further movable in a direction reverse from said first direction when said handle is pushed when over said rear portion of said platform.

* * * * *